US005325340A

United States Patent [19]

Ramsey

[11] Patent Number: 5,325,340

[45] Date of Patent: Jun. 28, 1994

[54] PACING DEVICE

[76] Inventor: Alexander W. Ramsey, 3501 Franklin Rd., Roanoke, Va. 24014

[21] Appl. No.: 99,710

[22] Filed: Jul. 29, 1993

[51] Int. Cl.[5] ..... G04F 8/00; G04F 7/00; G04B 47/00

[52] U.S. Cl. ..... 368/3; 368/10; 368/108; 368/110; 368/113

[58] Field of Search ..... 368/10, 79, 107–113, 368/3; 340/916–929, 309.15, 309.4

[56] References Cited

U.S. PATENT DOCUMENTS

| | | | |
|---|---|---|---|
| 3,846,704 | 11/1974 | Bessette | 340/331 |
| 3,872,423 | 3/1975 | Yeakley | 340/43 |
| 4,200,860 | 4/1980 | Fritzinger | 340/43 |
| 4,202,842 | 4/1981 | Grover | 368/10 |
| 4,590,455 | 5/1986 | Fritzinger | 340/907 |
| 4,785,432 | 11/1988 | Havel | 368/82 |
| 4,827,258 | 5/1989 | Evans | 340/929 |
| 4,995,018 | 2/1991 | Edwards | 368/107 |
| 5,059,943 | 10/1991 | LoBello | 340/309.4 |
| 5,130,955 | 7/1992 | Luerker et al. | 368/3 |

*Primary Examiner*—Vit W. Miska
*Attorney, Agent, or Firm*—Peter J. Van Bergen

[57] ABSTRACT

A pacing device provides feedback to a user based on a preselected pace time for an activity. A linear array of colored lights includes two lights of a first color and one light of a second color and is operated in accordance with a predetermined lighting sequence. The predetermined lighting sequence makes: 1) a combination of the two lights of the first color visible to the user during a time less than or equal to the preselected pace time, 2) a combination of one of the two lights of the first color and the one light of the second color visible to the user during a first portion of a time greater than the preselected pace time, and 3) only the one light of the second color visible to the user during a second portion of the time greater than the preselected pace time.

16 Claims, 4 Drawing Sheets

PACING DEVICE

FIELD OF THE INVENTION

The invention relates generally to pacing devices used in training athletes, and more particularly to a pacing device programmable by a user in accordance with a preselected pace time for a preselected number of repetitions of an activity such as lap swimming, or running/bicycling around a track.

BACKGROUND OF THE INVENTION

In most exercise or athletic training sessions, coaches provide the necessary incentive, encouragement and feedback about the level of effort being exerted by the performer. Such feedback is particularly important when the performer is trying to maintain a particular pace of activity for a period of time. Unfortunately, involvement by a coach is not always possible or practical. Further, many athletes train by doing distance workouts in a closed course environment such as a swimming pool or track. In such training workouts, the athlete must be able to pace himself as well as count the number of laps completed.

A variety of pacing devices have been disclosed in the prior art. For swimmers, such pacing devices include those in which a point of light moves clockwise around a "clock-like" circle of light emitting diodes in accordance with a preset pace time as taught by U.K. Patent No. 2,169,112. One revolution of the clock-like circle equates to a given pace time. However, the clock-like circle tends to mislead a swimmer since one revolution is most commonly equated with 60 seconds and not a preset pace time that may differ greatly from 60 seconds. In addition, the clock-like pacing device is maintained outside of the pool and therefore requires the swimmer to lift his head out of the water to look at the device which is usually placed at the end of the pool. However, as a swimmer raises his head out of the water to view the pacing device, water beads up on the swimmer's goggles and may obscure his vision. This not only makes it difficult to view the pacing device, but also diverts the swimmer's attention at a time when he may need to concentrate on executing a flip turn. The clock-like pacing device is also limited to a single pace. However, a long distance swimmer may want to train in accordance with a pace that changes (i.e., increases or decreases) during the course of a single event. Finally, the number of lights required to create a clock-like circle dictates that the ultimate device will be of a size, complexity and cost that is impractical for the average self-coached athlete.

Another type of training system designed for lap swimming, as well as running or biking on a track, involves the use of a flexible tube laid alongside the pool or track. The tube contains a series of internally arranged lamps that are sequentially illuminated in accordance with a frequency that equates to a preset pace time. Practically, this type of system requires a great deal of set-up time and lacks the portability for it to be useful in most training applications.

SUMMARY OF THE INVENTION

Accordingly, it is an object of the present invention to provide a simple pacing device that feeds back "ahead of pace" "on pace", and "behind pace" information to its user in an easily understood format.

Another object of the present invention is to provide a pacing device that is portable thereby allowing it to be set-up and operated by a single user.

Still another object of the present invention is to provide a pacing device having a feedback display that is submersible in water for use as a swimming pacing device.

Yet another object of the present invention is to provide a pacing device capable of being programmed with a variety of pace times for a single event to more realistically reflect the user's pace over the course of the event.

Other objects and advantages of the present invention will become more obvious hereinafter in the specification and drawings.

In accordance with the present invention, a pacing device provides feedback to a user based on a preselected pace time for an activity. A linear array of colored lights includes two lights of a first color and one light of a second color and is operated in accordance with a predetermined lighting sequence. The predetermined lighting sequence makes: 1) a combination of the two lights of the first color visible to the user during a time less than or equal to the preselected pace time, 2) a combination of one of the two lights of the first color and the one light of the second color visible to the user during a first portion of a time greater than the preselected pace time, and 3) only the one light of the second color visible to the user during a second portion of the time greater than the preselected pace time. A microcomputer unit has a processing circuit that counts to the preselected pace time and outputs a drive signal during counting. The drive signal enables the linear array in accordance with the predetermined light sequence. A power supply electrically connects the linear array and the microcomputer unit.

DETAILED DESCRIPTION OF THE INVENTION

Figure 1:
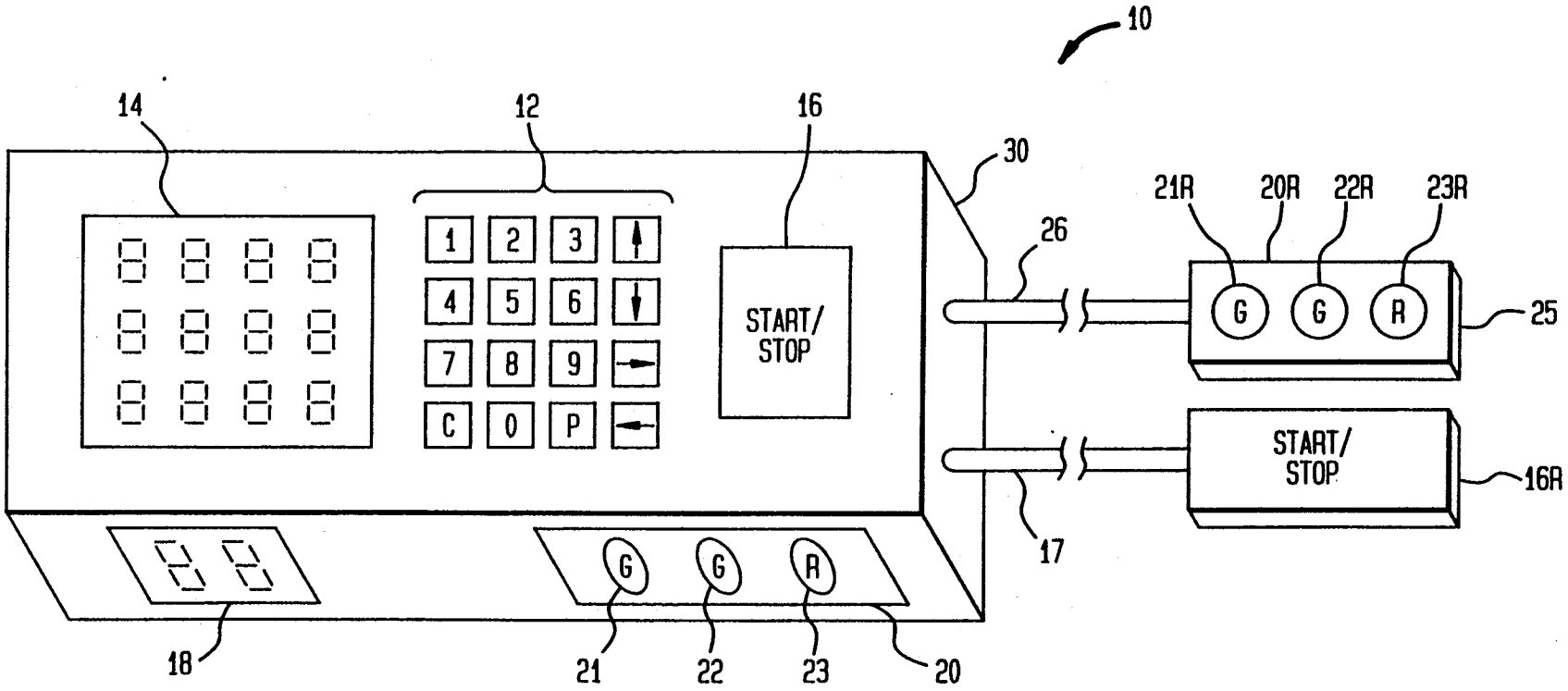
FIG. 1 is a perspective view of a pacing device in accordance with the present invention.

Referring now to the drawings, and more particularly to FIG. 1, a perspective view is shown of the pacing device 10 according to the present invention. By way of example, pacing device 10 will be described relative to a lap swimming training exercise. However, it is to be understood that pacing device 10 applies equally as well to other closed course events (e.g., running, bike riding, etc.) in which pace is paramount to good performance.

In a preferred embodiment, pacing device 10 includes a keypad 12 for receiving user input data, an alphanumeric display 14 for prompting a user for input and for reviewing input data a start/stop touch pad 16, a digital counter 18, and a linear array 20 of light emitting diodes (LEDs) 21, 22 and 23. LEDs 21 and 22 are selected to be one color (e.g., green denoted in FIG. 1 by the letter "G") and LED 23 is selected to be another color (e.g., red denoted in FIG. 1 by the letter "R"). Typically, pacing device 10 is maintained within a single container 30 which is submersible in water for use as a lap swimmer's pacing device. Alternatively, pacing device 10 may be equipped with a remote linear array 20R of LEDs, 21R, 22R and 23R contained within a submersible housing 25 and tethered mechanically and electrically to container 30 by an electrical cable 26. Pacing device 10 might alternatively be equipped with a remote start/stop touch pad 16R tethered mechanically and electrically to container 30 by an electrical cable 17. Regardless of configuration, operation of pacing device 10 is the same.

Figure 2:
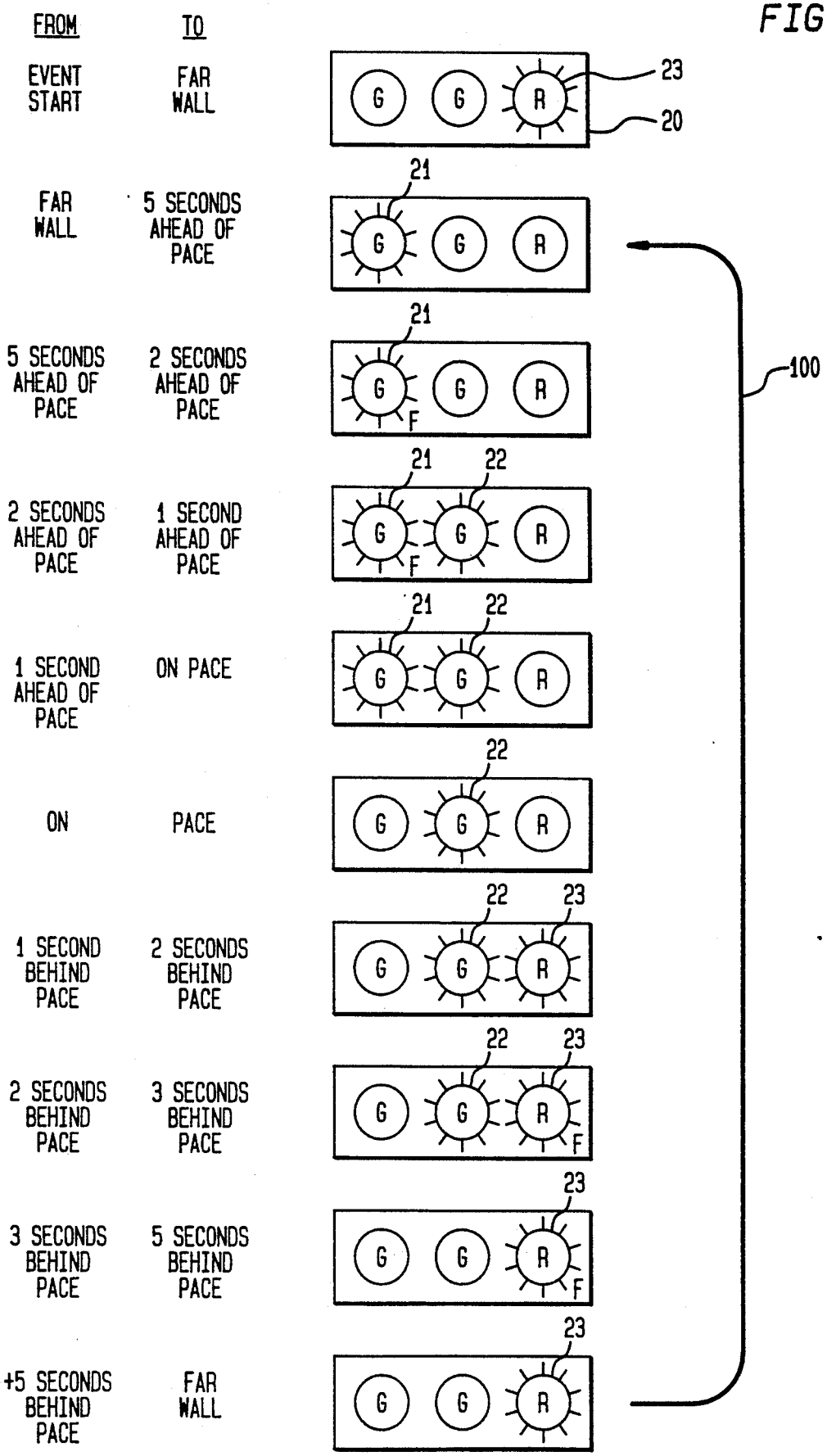
FIG. 2 depicts a representative lighting sequence for the linear array of light emitting diodes (LEDs) for one lap of an event being paced.

In its simplest form of operation for lap swimming in a pool, a user inputs a number of laps and either a preselected time for completion of the laps or a preselected pace or target time per lap. Assuming container 30 is submersible (i.e., neither remote linear array 20R or remote start/stop touch pad 16R are required), the user places pacing device 10 at the bottom of the pool where the pre-programmed lap swim or event will begin. Upon starting the event by actuating start/stop touch pad 16, linear array 20 will follow a preprogrammed lighting sequence. One such lighting sequence will be described for one lap with reference to FIG. 2. By way of convention, hash marks around the circumference of LEDs 21, 22 and 23 indicate that the particular LED is enabled. Further, the letter "F" appearing underneath one of the LEDs indicates that the particular LED is flashing on and off at a fast rate, e.g., 5 times per second. The absence of the letter "F" indicates that the particular LED is steadily on for the time frame indicated.

Upon starting the event, LED 23 is steadily enabled or lit for one-half of the preselected pace time for the lap. At the halfway point of the preselected pace time (i.e., when the swimmer should be turning at the far wall) LED 23 turns off and LED 21 is steadily lit. This condition continues until the swimmer is approaching the target time for the lap. For example, LED 21 may begin to flash on and off at 5 seconds prior to the target time (i.e., "ahead of pace"). The flashing condition of LED 21 may continue until 2 seconds prior to the target time at which point LED 21 may continue to flash while LED 22 is steadily lit. At 1 second prior to the target time, both LEDs 21 and 22 are steadily lit. When the target time (i.e., "on pace") is reached, only LED 22 is steadily lit. It is at the target time that the swimmer should be completing the lap and turning to start the next lap. However, in the event that the swimmer has missed the target time (i.e., "behind pace"), he will see LED 22 and LED 23 steadily lit to indicate that he is 1 second behind the target time. If the swimmer is 2 seconds behind, he will see LED 22 steadily lit while LED 23 will flash on and off. If the swimmer is 3-5 seconds late, he will see just LED 23 flashing on and off. Finally, LED 23 will remain steadily lit until the halfway point is reached in the target time for the current lap at which point the sequence repeats itself as indicated by arrow 100. Thus, the timing of the lights is only dependent on the programmed pace.

It is to be understood that the foregoing sequence and time constraints dictating same are a design choice. For instance, a novice learning how to pace himself may require a window of time defining "on pace", while an experienced swimmer may always be within one or two seconds of his pace. Accordingly, the particular programming of LEDs 21, 22 and 23 may vary based on the required precision of the swimmer's pace. Regardless of the required precision, it is critical that only LEDs 21 and/or 22 are lit if the swimmer is ahead of or on pace, that a combination of LEDs 22 and 23 are lit if the swimmer is "slightly" (as defined by the required precision) behind pace, and that only LED 23 is lit if the swimmer is "considerably" (once again, as defined by the required precision) behind pace.

During the event, pacing device 10 counts completed laps and displays same on digital counter 18. Note that it is desirable to increment lap counter 18 prior to the swimmer's completion of a lap in order to provide relevant feedback. By way of example, incrementing lap counter 18 might occur at the halfway point in each lap. The swimmer does not need to activate the lap counter in any way. This eliminates possible counting errors and frees the swimmer to concentrate on other elements of his event.

Since an event encompasses multiple laps that may not be performed at a steady pace throughout, pacing device 10 may receive multiple pace times associated with a particular event. For example, a swimmer who is strong early on in an event but weak later in the event, could program an event that trained him to reduce his pace early on while increasing it later in the event.

Figure 3:
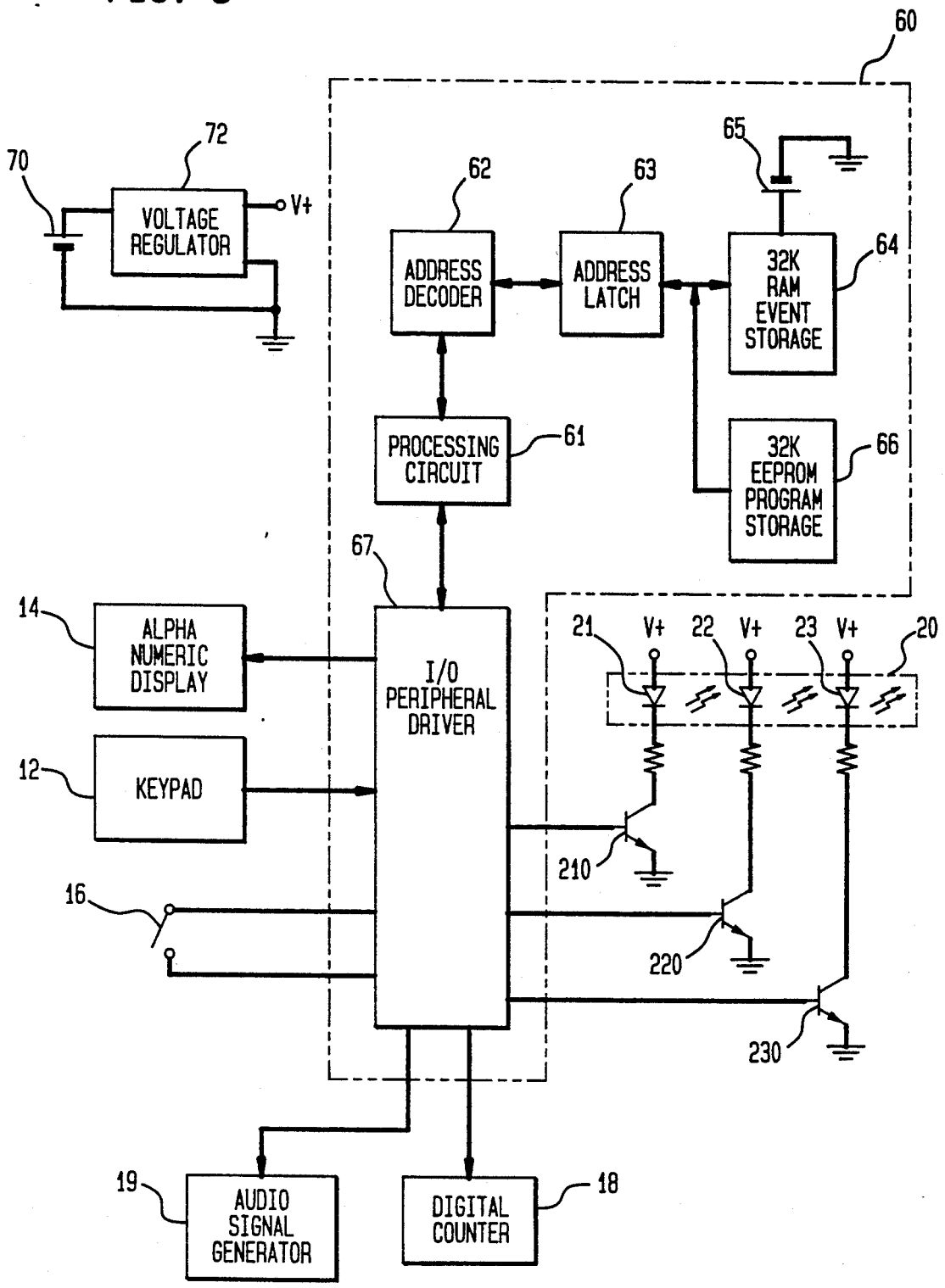
FIG. 3 is a block diagram of a microcomputer and its peripherals for operating the present invention according to a preferred embodiment.

A preferred embodiment microcomputer and peripherals for controlling power supplied to linear array 20 in accordance with the above-described operation is shown in block diagram form in FIG. 3. Microcomputer 60 includes a processing circuit 61 (e.g., an 80C52 chip), an address decoder 62 (e.g., an LSHC139 chip) an address latch 63 (e.g., an LSHC373 chip), a 32K random access memory (RAM) 64 for storing user programmed events, a long-life battery 65 (e.g., a +5 volt, 10-year lithium battery) to make event storage RAM nonvolatile, a 32K electronically erasable programmable read only memory (EEPROM) 66 for storing the operating program for processing circuit 61, and an input/output (I/O) peripheral driver 67 (e.g., an 8255A chip). Address decoder 62 interprets addresses passed therethrough as relating to event storage RAM64 or program storage EEPROM 65. Address latch 63 serves to hold data or instructions until processing circuit 61 is ready. All components are chosen so as to consume the least amount of power from battery 70.

Peripherals connected to microcomputer 60 via I/O peripheral driver 67 include keypad 12, alphanumeric display 14, start/stop touch pad 16, digital counter 18 and linear array 20. An audio signal generator 19 (e.g., a piezoelectric buzzer) may also be provided to provide the user with an audible signal to indicate, for example, the starting and/or timing out of an event.

Power for microcomputer 60 and its peripherals is supplied by a battery 70 (e.g., a NiCd battery pack that is rechargeable) and regulated by voltage regulator 72. The output V+ of regulator 72 is continuously supplied to each LED 21, 22 and 23. However, each LED is turned on only when its respective in-line transistor 210, 220 and 230 is turned on from a signal received from I/O driver 67 in accordance with the appropriate lighting sequence for that moment in a lap.

Operation of microcomputer 60 is as follows. A user must first program processing unit 61 with an event to be timed by either inputting (at keypad 12) a new event or selecting (at keypad 12) a previously programmed event stored in event storage RAM 64. Once again, an event for purposes of lap swimming is a number of laps at a single selected time per lap or, alternatively, groups of laps such that each group is associated with a different pace time. For example, an event might involve 40 laps with each lap paced at 40 seconds for a total event program time of 26 minutes and 40 seconds. In this case, the light sequence described above with reference to FIG. 2 would be repeated 40 times. The 40 lap event might also be broken up into multiple groups of laps where each group has its own pace. For example, the 40 laps might be input as the first 10 laps with each lap paced at 36 seconds, the next 20 laps paced at 40 seconds per lap and the last 10 laps paced at 38 seconds per lap for a total event program time of 25 minutes and 40 seconds. In this case, the light sequence would still be repeated 40 times, but the time per lap would coincide with the particular lap time dictated by the current group.

When a new event is input at keypad 12, I/O peripheral driver 67 passes the event information to processing circuit 61 which stores the event data locally and gives the event data an address. The event address and data are routed to event storage RAM 64 and stored therein. If a previously stored event is selected at keypad 12, I/O peripheral driver 67 passes the event request to processing circuit 61. The address assigned to the desired event is used to fetch the previously stored event data from event storage RAM 64. The fetched data is then passed back to processing unit 61 where it is stored locally.

Once programmed, pacing device 10 may be started by triggering start/stop touch pad 16. I/O peripheral driver 67 passes a "start" signal to processing unit 61. At this point, a counter or clock internal to processing unit 61 begins to count up to the pace time dictated by the event stored locally in processing unit 61. Counting to the pace time is restatted/repeated for the number of laps in the event or, in the case of a multiple group event, the number of laps in the group. Further, for a multiple group event, the pace time automatically changes based on the locally stored event specifics.

For each repetitive count of the pace time, enable signals are passed to in-line transistors 210, 220 and 230 via I/O peripheral driver 67. The enable signals coincide with preprogrammed lighting sequence such as the representative sequence described above with reference to FIG. 2. At some point during each repetition, a counter is incremented within processing unit 61 to coincide with the current lap number. The count is output to digital counter 18. As mentioned above, one possible time to do this is at the midpoint of a lap. In this way, the swimmer gets one length of the pool to see what lap he is currently completing. Digital counter 18 might also be flashed on and off for the next-to-last and/or last lap of an event to further highlight to the user that the event is near completion. In addition, the total event running time may be displayed on alphanumeric display 14. At completion of the event, the swimmer merely strikes start/stop touch pad 16. Confirmation of an effective start or stop may be provided by an audible signal output from audio signal generator 19.

The advantages of the present invention are numerous. The linear array of three lights provides a simple recognizable "ahead of pace", "on pace" or "behind pace" feedback system for an athlete such as a swimmer, runner or bicyclist who is repeating an event at a target pace. The small size of the linear array provides for a simple system for controlling the array. Thus, the pacing device of the present invention is easily made portable for set-up and use by a single user. By encasing the entire pacing device or, alternatively, at least the linear array of LEDs, in a submersible container, the present invention will find great utility as a training device for lap swimmers since the swimmer need not look outside the pool for pace information. The compact nature of the present invention's linear array also makes it well suited for inclusion in a pair of swim goggles or glasses thereby alleviating any problems associated with a user's vision. Further, since the pacing device automatically executes a restart of the pace counter with each paced lap, the swimmer need only be concerned with hitting a touch pad at the beginning or end of the event. The ability to program an event with varied pace times over the course of the event provides for a more realistic training scenario based on an individual's strengths/weaknesses.

Figure 4:
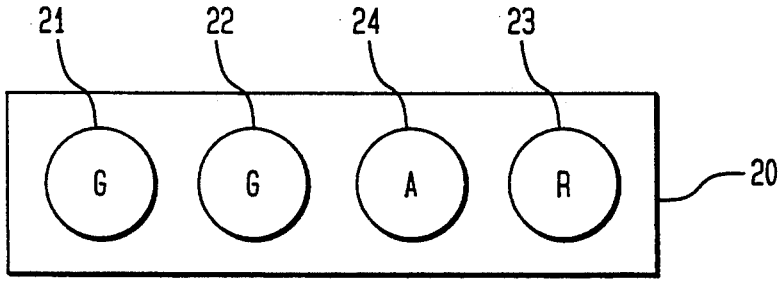
FIG. 4 is alternative lighting arrangement for the linear array of the present invention.

While the present invention has been described relative to a particular embodiment, it is not so limited. For example, if space and power were available, the linear array of LEDs could be expanded to include a greater number of LEDs. In addition, a third color LED 24 (e.g., amber denoted in FIG. 4 by the letter "A") might be added and placed between LEDs 22 and 23 as shown in the lighting display of FIG. 4. In this case, LED 24 would only be lit when the pace time is reached for each lap in the event. This provides a clear indication of "on pace" to the user at the expense of additional size and power requirements.

Thus, although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A pacing device for providing feedback to a user based on a plurality of different preselected pace times for an activity to be repeated over a set distance, comprising:

a linear array of colored lights, said linear array consisting of two lights of a first color and one light of a second color;

means for storing said plurality of different preselected pace times in accordance with a sequence supplied by said user, said sequence defining a plurality of groups of said activity and a corresponding one of said plurality of different preselected pace times to complete said set distance for said activity in each of said plurality of groups; and means for controlling power to said linear array of colored lights in accordance with said sequence, wherein said sequence makes: 1) a combination of said two lights of said first color visible to said user during a time less than or equal to said corresponding one of said plurality of different preselected pace times, 2) a combination of one of said two lights of said first color and said one light of said second color visible to said user during a first portion of a time greater than said corresponding one of said plurality of different preselected pace times, and 3) only said one light of said second color visible to said user during a second portion of said time greater than said corresponding one of said plurality of different preselected pace times.

2. A pacing device as in claim 1 wherein said linear array is enclosed in a water submersible container.

3. A pacing device as in claim 1 wherein said linear array of colored lights comprises a linear array of colored light emitting diodes.

4. A pacing device as in claim 1 wherein said linear array of colored lights is arranged sequentially from left to right as viewed by said user in order of said first and second colors.

5. A pacing device as in claim 1 wherein said linear array of colored lights further comprises one light of a third color indicative only of said time equal to said corresponding one of said plurality of different preselected pace times and visible to said user only during said time equal to said corresponding one of said plurality of different preselected pace times.

6. A pacing device as in claim 5 wherein said linear array of colored lights is arranged sequentially from left to right as viewed by said user in order of said first, third and second colors.

7. A pacing device for providing "ahead of pace", "on pace" and "behind pace" feedback to a swimmer based on a plurality of different preselected pace times for a lap to be repeated, comprising:

a linear array of colored lights, said linear array consisting of two lights of a first color and one light of a second color, said linear array of colored lights operated in accordance with a sequence supplied by said swimmer, said sequence defining a plurality of groups of said lap and a corresponding one of said plurality of different preselected pace times to complete said lap in each of said plurality of groups, wherein said sequence makes: 1) a combination of said two lights of said first color visible to said swimmer during a time less than or equal to said corresponding one of said plurality of different preselected pace times as said "ahead of pace" feedback, 2) a combination of one of said two lights of said first color and said one light of said second color visible to said swimmer during a first portion of a time greater than said corresponding one of said plurality of different preselected pace times as said "on pace" feedback, and 3) only said one light of said second color visible to said swimmer during a second portion of said time greater than said corresponding one of said plurality of different preselected pace times as said "behind pace" feedback;

a microcomputer unit including local storage means for storing said plurality of different preselected pace times, said microcomputer unit further having a processing circuit that counts to said corresponding one of said plurality of different preselected pace times and outputs a drive signal during counting, said drive signal enabling said linear array in accordance with said sequence; and a power supply electrically connected to said linear array and said microcomputer unit.

8. A pacing device as in claim 7 wherein said microcomputer unit further comprises random access memory for storing said plurality of different preselected pace times.

9. A pacing device as in claim 8 further comprising means for inputting said plurality of different preselected pace times.

10. A pacing device as in claim 9 further comprising a display for viewing said plurality of different preselected pace times stored in said random access memory.

11. A pacing device as in claim 7 wherein said processing circuit counts to each said corresponding one of said plurality of different preselected pace times for each said lap to increment a digital count, said pacing device further comprising means for displaying said digital count.

12. A pacing device as in claim 7 wherein said linear array is enclosed in a water submersible container.

13. A pacing device as in claim 7 wherein said linear array of colored lights comprises a linear array of colored light emitting diodes.

14. A pacing device as in claim 7 wherein said linear array of colored lights is arranged sequentially from left to right as viewed by said swimmer in order of said first and second colors.

15. A pacing device as in claim 7 wherein said linear array of colored lights further comprises one light of a third color indicative only of said time equal to said corresponding one of said plurality of different preselected pace times and visible to said swimmer only during said time equal to said corresponding one of said plurality of different preselected pace times as said "on pace" feedback.

16. A pacing device as in claim 15 wherein said linear array of colored lights is arranged sequentially from left to right as viewed by said swimmer in order of said first, third and second colors.

* * * * *